US010864621B2

(12) United States Patent
Obesser

(10) Patent No.: US 10,864,621 B2
(45) Date of Patent: Dec. 15, 2020

(54) DEVICE FOR BENDING A SPLIT PIN

(71) Applicant: MAN Truck & Bus AG, Munich (DE)

(72) Inventor: Johann Obesser, Markt Indersdorf (DE)

(73) Assignee: MAN Truck & Bus AG, Munich (DE)

( * ) Notice: Subject to any disclaimer, the term of this patent is extended or adjusted under 35 U.S.C. 154(b) by 204 days.

(21) Appl. No.: 15/980,457

(22) Filed: May 15, 2018

(65) Prior Publication Data

US 2018/0333833 A1 Nov. 22, 2018

(30) Foreign Application Priority Data

May 16, 2017 (DE) ..... 10 2017 004 648

(51) Int. Cl.
*B25B 27/08* (2006.01)
*B25B 27/20* (2006.01)

(52) U.S. Cl.
CPC ..... *B25B 27/08* (2013.01); *B25B 27/20* (2013.01); *B25B 27/205* (2013.01)

(58) Field of Classification Search
CPC ..... B25B 33/00; B25B 27/08; B25B 27/20; B25B 27/205; B25B 7/00; B25B 7/02; B25B 7/04; B25B 7/06; B25B 7/10; B25B 25/00; Y10T 29/53809; F16B 21/12
USPC ..... 29/247, 249, 225, 243.56, 271; 269/3, 6, 269/95, 249, 143; 411/364; 72/409.01; 81/304, 345, 418, 485
See application file for complete search history.

(56) References Cited

U.S. PATENT DOCUMENTS 1,649,513 A 11/1927 Dandeneau
2,631,363 A * 3/1953 Verne Fahlstrom .... B25C 11/00 29/247
2,750,822 A * 6/1956 Kossuth ..... B25B 27/08 72/384

(Continued)

FOREIGN PATENT DOCUMENTS

CN 104924272 A 9/2015
DE 202014008807 U1 2/2015

(Continued)

OTHER PUBLICATIONS

Search Report from German Patent Office in corresponding application DE102017004648, dated Jan. 16, 2018.

(Continued)

*Primary Examiner* — Orlando E Aviles
*Assistant Examiner* — Robert F Neibaur
(74) *Attorney, Agent, or Firm* — Maginot, Moore & Beck LLP

(57) ABSTRACT

The invention relates to a device (18) for bending a split pin (4) for securing the position of a workpiece (2), in particular for securing a castellated nut against rotation. The device has a tool body (22) and a holding component (20) for holding the split pin (4) during a bending procedure. The holding component (20) is mounted so as to be rotatable on the tool body (22). The device (18) has a bending element (26) that is disposed on the tool body (22) such that an end of a split pin (4) that is held on the holding component (20) is capable of being bent back by a relative rotation on the bending element (26), in particular in a manner so as to be flush with the shape of the workpiece (2), between the holding component (20) and the tool body (22).

20 Claims, 4 Drawing Sheets

(56) References Cited

U.S. PATENT DOCUMENTS

| | | | | | |
|---|---|---|---|---|---|
| 2,854,874 | A | | 10/1958 | Decker | |
| 4,995,274 | A | * | 2/1991 | Kleeman | F16B 39/04 411/13 |
| 5,819,580 | A | * | 10/1998 | Gauthier | B21D 7/063 72/458 |

FOREIGN PATENT DOCUMENTS

| | | | | | |
|---|---|---|---|---|---|
| DE | 20 2014 008 807 | | * | 3/2015 | B25B 27/20 |
| JP | S5457299 | A | | 5/1979 | |
| JP | S6084271 | U | | 6/1985 | |
| JP | S63136881 | U | | 9/1988 | |
| JP | 2010284730 | | * | 12/2010 | B25B 27/205 |
| JP | 2010284730 | A | | 12/2010 | |
| KR | 101257027 | B1 | * | 4/2013 | |

OTHER PUBLICATIONS

European Search Report for related application EP 18168654.4, dated Oct. 22, 2018.

* cited by examiner

DEVICE FOR BENDING A SPLIT PIN

The invention relates to a device for bending a split pin.

A split pin is a securing element which serves for securing the position of connected components. For example, nuts, in particular castellated nuts, by way of a split pin can be secured against inadvertent rotation. In order for the split pin to be prevented from sliding out, the ends of the split pin can be bent back. To this end, the split pin ends can be struck by means of a hammer.

This has the disadvantage that the product to be secured can be damaged by way of the hammer strokes. Moreover, there is a substantial variation in terms of the quality of the work and the required time duration. As the split pins increase in thickness, the effects described are correspondingly amplified. Moreover, by virtue of the use of the hammer, there is a risk of injury to the user of the hammer.

A number of tools which can be used for releasing or fastening a split pin are known in the prior art. A tool of this type is disclosed, for example, in U.S. Pat. No. 1,649,513.

The invention is based on the object of providing an (alternative) device for bending a split pin, by way of which a reliable bending back of the split pin ends, in particular for securing a castellated not against rotation, is enabled at a consistent quality of work.

The object is achieved by a device according to the independent claim. Advantageous refinements are stated in the dependent claims and in the description.

The device (split pin bending tool) serves for bending a split pin for securing the position of a workpiece, in particular for securing a nut, preferably a castellated nut, against rotation. The device has a tool body and a holding component for holding the split pin during a bending procedure (of the split pin). The holding component is mounted so as to be rotatable on the tool body. The device has a bending element. The bending element is disposed on the tool body such that an end of a split pin that is held on the holding component is capable of being bent back by a relative rotation on the bending element, in particular in a manner so as to be flush with the shape of the workpiece, between the holding component and the tool body.

The relative rotation between the holding component and the tool body (and thus between the split pin that is held in the holding component and the tool body) enables a reliable and rapid bending back of the split pin ends of a split pin at a consistent quality of work. Since no hammer has to be used, the risk of injury is moreover reduced, and the component to be secured cannot be damaged by the hammer The device can in particular bend back split pin ends of a split pin.

In particular, a rotation axis of the holding component can run so as to be inclined, preferably perpendicular, in relation to a longitudinal axis of the tool body.

The tool body can in particular have an outrigger for rotatably mounting the holding component.

The bending element can in particular be disposed at an end of the tool body.

The bending element can in particular be fastened or attached in a locationally fixed manner in relation to the tool body, preferably in relation to an outrigger of the tool body.

The split pin can in particular have two legs which are connected by way of a split pin head. The two legs of the split pin can preferably be of dissimilar lengths and collectively form a round cross section. The split pin head can preferably be designed as an approximately circular loop.

The split pin can in particular be configured as a standard split pin according to DIN EN ISO 1234.

The split pin can have any size. The split pin can preferably have a length which is greater than or equal to 100 mm, and/or a diameter which is adapted to a bore diameter of 8 mm or larger (so-called size 8 split pin, or larger).

In one embodiment, a first split pin end of the split pin is capable of being bent back by a relative rotation on the bending element between the tool body and the holding component in a first rotation direction. A second split pin end of the split pin is capable of being bent back by a relative rotation on the bending element between the tool body and the holding component in a second rotation direction which is counter to the first rotation direction. Both split pin ends of a split pin can thus be bent back by two pivoting movements of the device in opposite directions.

In a further embodiment, the holding component holds the split pin on a split pin head of the split pin. Alternatively or additionally, the holding component has a mounting for holding a split pin head of the split pin. The mounting can be configured in particular as a pin or a protrusion.

In one exemplary embodiment, the holding component during the relative rotation between the holding component and the tool body is securable in a rotationally fixed manner on the workpiece. A relative rotation between the workpiece (nut, castellated nut), the split pin and the holding component, on the one hand, and the tool body and the bending element, on the other hand, is thus enabled.

In a further exemplary embodiment, the holding component is configured to mesh with the workpiece that is configured in particular as a nut, preferably a castellated nut, in order for the holding component to be secured in a rotationally fixed manner on the workpiece. Alternatively or additionally, the holding component has at least one fastening element for securing the holding component in a rotationally fixed manner on the workpiece.

In a preferred exemplary embodiment, the at least one fastening element is configured for engaging in at least one clearance in a castellated portion of the workpiece that is configured as a castellated nut. The holding component during the bending procedure of the split pin can thus be securely held on the castellated nut.

In one variant of embodiment, the holding component is configured as a turntable. The turntable can in particular have an external wall region that is configured as a ring segment portion, in particular a half-ring segment portion.

The external wall region as a protrusion can extend in particular from a plate region of the holding component in particular in a direction that is parallel with a central axis, and in a circumferential direction about the central axis of the holding component.

In one refinement, the external wall region is disposed on a side of the holding component that faces away from the bending element. Alternatively or additionally, the external wall region is configured for partially encompassing the workpiece, in particular the castellated nut.

In one further variant of embodiment, the external wall region has a clearance for passing through the split pin, in particular a split pin portion that adjoins a split pin head of the split pin.

In one embodiment, the mounting and/or the clearance are/is disposed on a side of the holding component that faces away from the bending element.

In a further embodiment, the holding component is mounted so as to be displaceable on the tool body such that in particular a spacing between the holding component and the bending element is variable. This can enable the potential for adapting to the predefined geometry of the workpiece and of the split pin, on the one hand. On the other hand, this can enable the bending element to be positioned as close as possible to the workpiece such that the split pin ends can be bent back so as to bear on the workpiece in a manner flush with the shape of the latter.

In one refinement, the tool body has a slot in which the holding component is displaceably mounted such that in particular a spacing between the mounting component and the bending element is variable.

In a further variant of embodiment, the device furthermore has a mechanism for converting a pivoting movement between two handle parts of the tool body to a translatory movement of the holding component, in particular in a direction toward or away from the bending element. The bending element can thus be positioned tightly on the workpiece in a simple manner such that the split pin ends can be bent back so as to bear on the workpiece in a manner flush with the shape of the latter. The bending element prior and post bending can be removed from the workpiece and split pin that is held in the holding component, in order for a placing and a removal of the device to be facilitated.

In one refinement, the holding component is connected to a thrust bar for displacing the holding component.

In a preferred variant of embodiment, the tool body has a first handle part and a second handle part which is pivotally connected to the first handle part. Pivoting of the second handle part in relation to the first handle part causes a displacement of the holding component in relation to the bending element by means of the thrust bar.

In one exemplary embodiment, the bending element is configured as a pin which preferably has one bending edge and two in particular planar bending faces which are interconnected by way of the bending edge.

In particular, the fastening elements, proceeding from the external wall region, can be configured so as to extend radially inward toward a central axis of the holding component, and/or be configured as pins.

The preferred embodiments and features of the invention described above can be combined with one another in an arbitrary manner. Further details and advantages of the invention are described hereunder with reference to the appended drawings in which.

The embodiments shown in the figures are at least in part identical so that similar or identical parts are provided with the same reference signs, reference also being made to the description of the other embodiments or figures, respectively, for explaining said embodiments, so as to avoid repetitions.

Figure 1:
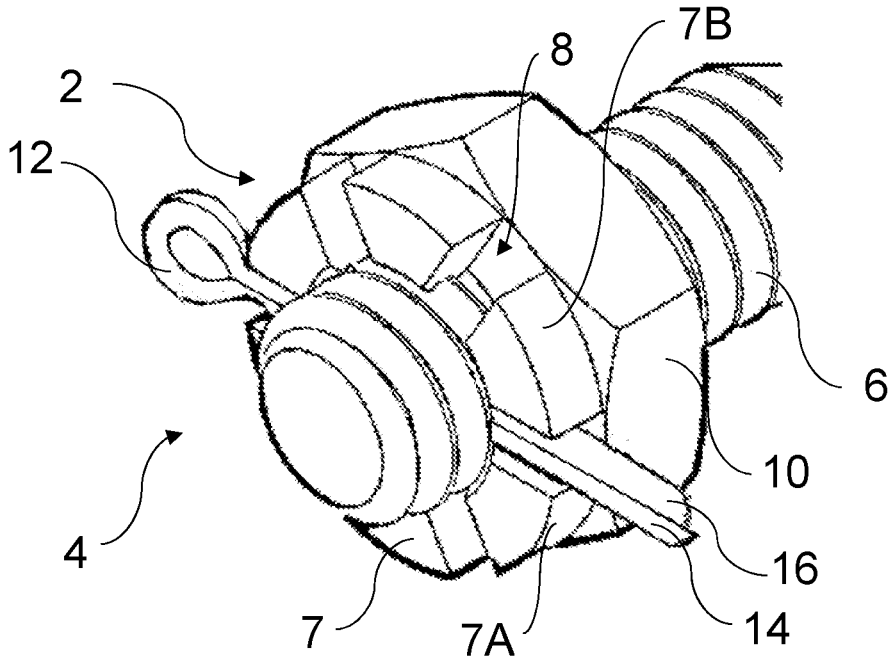
FIG. 1 shows a perspective view of an assembly having a castellated nut, a split pin, and a threaded bar.

FIG. 1 shows a castellated nut 2, a split pin 4, and a threaded bar or a screw end 6.

The castellated nut 2 has an internal thread for screwing onto the threaded bar 6. The castellated nut 2 serves for fastening a component (not illustrated) on the threaded bar 6. The castellated nut 2 moreover has a castellated portion 7 having a plurality of mutually spaced apart clearances 8 (six clearances in the example of FIG. 1) in order for the split pin 4 to be passed through. The castellated nut 2 can additionally have a main body portion 10 which is configured as a hexagon head.

The split pin 4 has a split pin head 12, a first leg 14, and the second leg 16. The split pin head 12 connects the first leg 14 and the second leg 16. The first leg 14 and the second leg 16 are of dissimilar length. The first leg 14 and the second leg 16 collectively can define a round cross section. The split pin head 12 has a substantially circular loop form. The split pin 4 can in particular be a standard split pin according to DIN EN ISO 1234.

The split pin 4 can be used in order for the castellated nut 2 to be connected in a rotationally fixed manner to the threaded bar 6. The first and the second leg 14, 16 of the split pin 4 can be guided through two clearances 8 of the castellated portion 7 and through a transverse bore through the threaded bar 6. The respective ends of the legs 14 and 16 that are opposite the split pin head 12 can subsequently be bent back in order for the split pin 4 to be secured. The split pin ends are bent back such that said split pin ends bear on the external circumferential faces 7A and 7B.

According to a conventional technique, the split pin ends of the legs 14 and 16 can be worked with a hammer, for example, in order to be bent back. This is associated with a risk of injury by the use of the hammer, and with variable quality in the bending back of the split pin ends.

Figure 2:
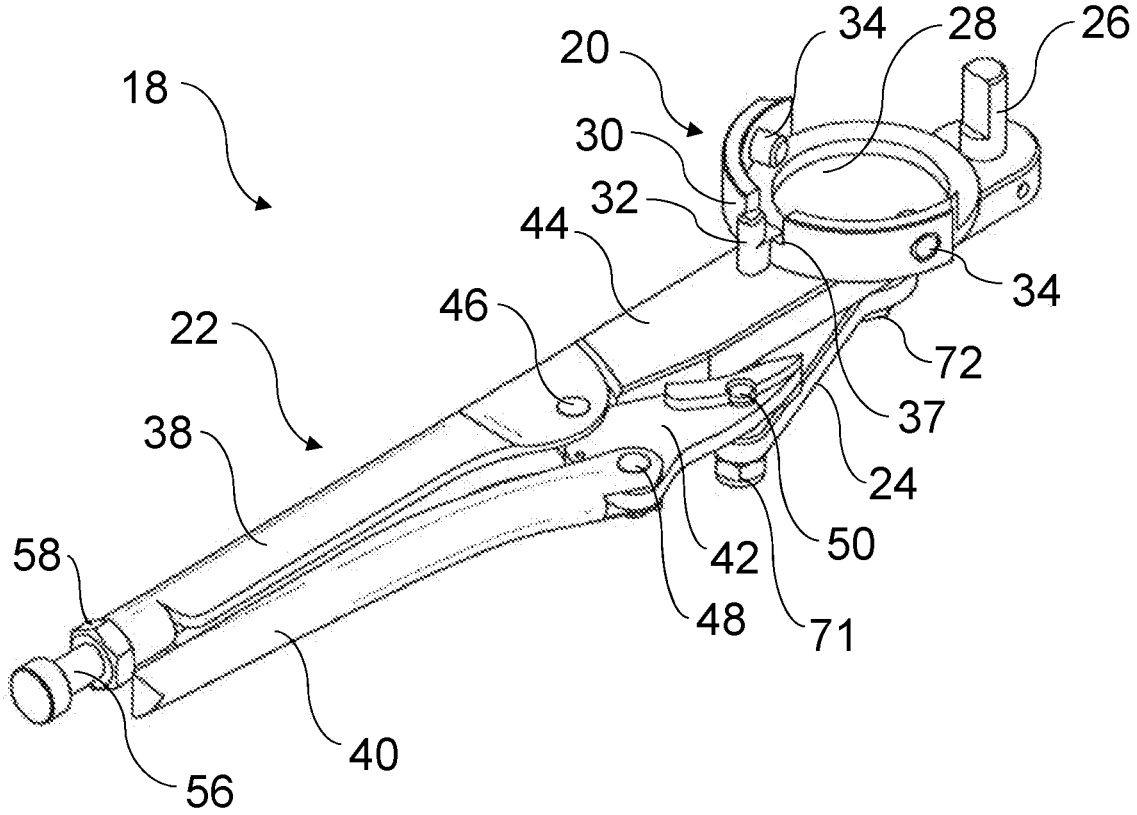
FIG. 2 shows a perspective view of a device for bending a split pin.
Figure 3:
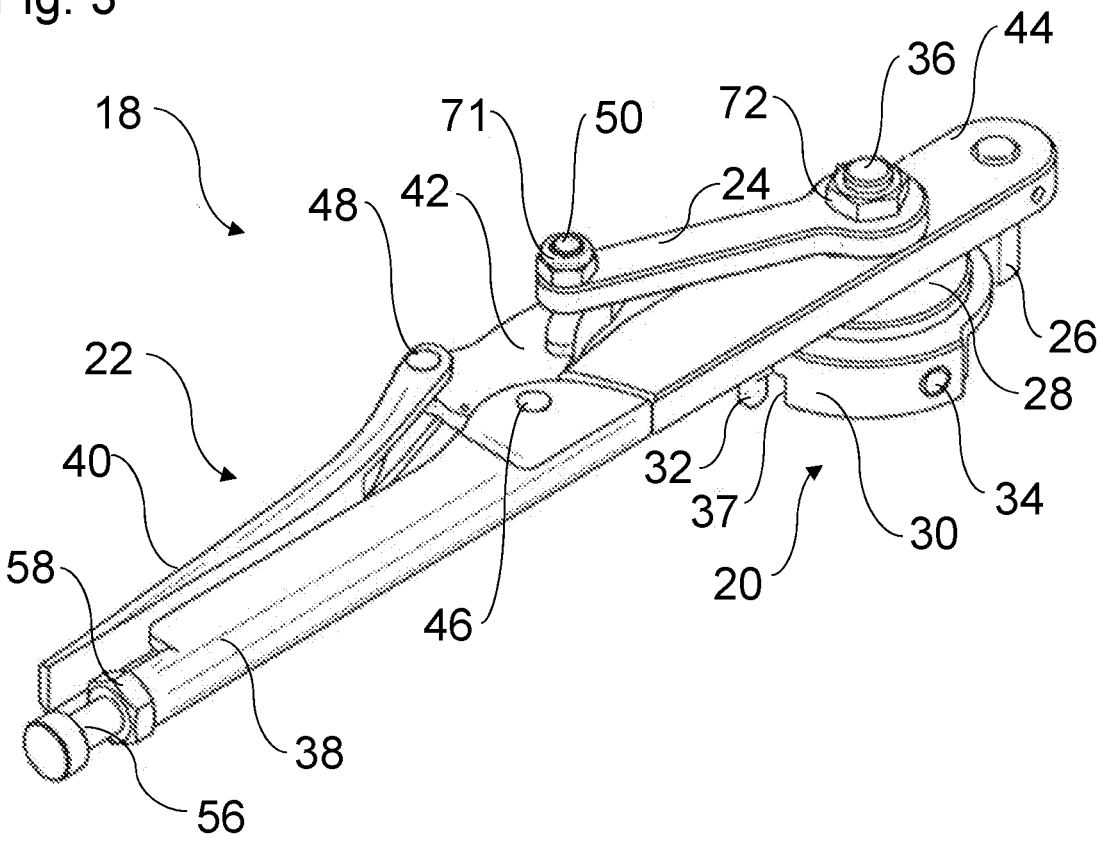
FIG. 3 shows a further perspective view of the device for bending a split pin.

FIGS. 2 and 3 so a device 18 for bending the split pin ends of a split pin in two different views (obliquely from above, and obliquely from below). The device 18 has a holding component 20, a tool body 22, a thrust bar 24, and a bending element 26. Prior to describing the interaction of the individual components of the device 18, the individual components will first be described in more detail with reference to FIGS. 4 to 7.

Figure 4:
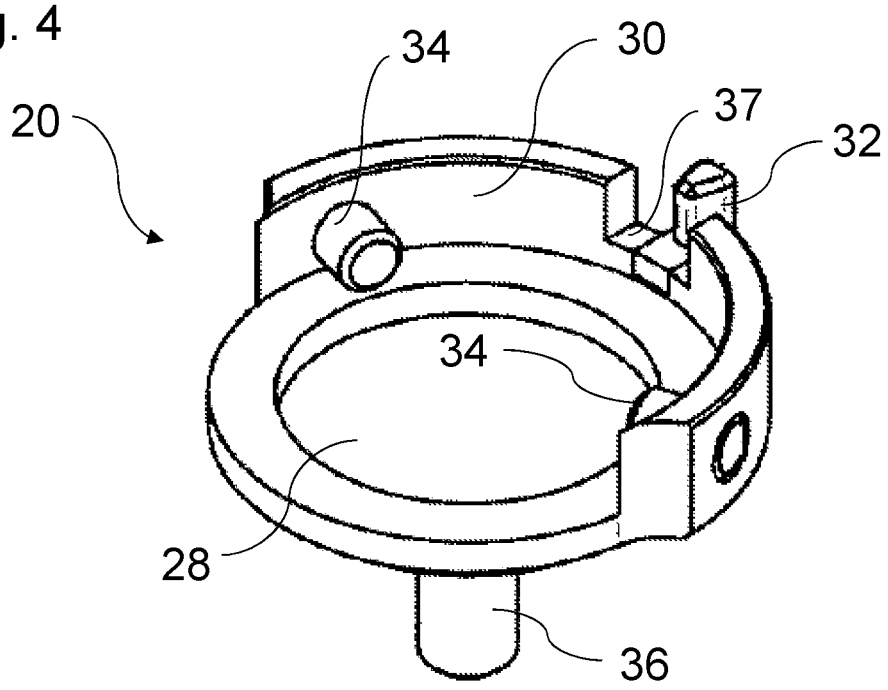
FIG. 4 shows a detailed view of the holding component of the device for bending a split pin.

FIG. 4 shows the holding component 20. The holding component 20 is configured as a turntable. The holding component 20 enables fixing/holding of the split pin 4 and of the castellated nut 2 (cf. FIG. 1) during the bending back of the split pin ends.

The holding component 20 has a plate region 28, an external wall region 30, a mounting or mount 32, fastening elements 34, and a fulcrum pin 36.

The plate region 28 has a depression for receiving an end of the threaded bar 6 that extends beyond the castellated nut 2 (cf. FIG. 1). The external wall region 30, the mounting 32, and the fastening element 34, on the one hand, and the fulcrum pin 36, on the other hand, are disposed on opposite sides of the plate region 28. The plate region 28 can have a circular shape, for example.

The external wall region 30 is configured as a ring segment. The external wall region 30 can be configured such that the castellated nut 2, in particular the castellated portion 7, can be partially encompassed (surrounded).

The mounting 32 is fastened to the external wall region 30, for example press-fitted therein. The mounting 32 serves for holding the split pin head 12 during the bending back of the split pin 4 (cf. FIG. 1). In particular, the mounting 32 can be introduced into the loop that is formed by the split pin head 12. In other words, the split pin head 12 can be placed onto the mounting 32. The split pin 4 can thus be held by the holding component 20.

Proceeding from the external wall region 30, the fastening elements 34 extend radially inward toward a central axis of the holding component 20. The fastening elements 34 are configured for engaging in the clearances 8 in the castellated portion 7 of the castellated nut 2 (cf. FIG. 1). On account thereof, the holding component 20 can be fastened or fixed temporarily to the castellated nut 2. The fastening elements 34 are configured, for example, as pins which are fastened, for example screw-fitted or press-fitted, in openings in the external wall region 30.

In the embodiment shown, the holding component 20 has two fastening elements 34. More or fewer fastening elements can be comprised in other embodiments.

The split pin 4 (cf. FIG. 1) that is held on the split pin head 12 by the mounting 32 can extend through a clearance 37 in the external wall region 30.

Figure 5:
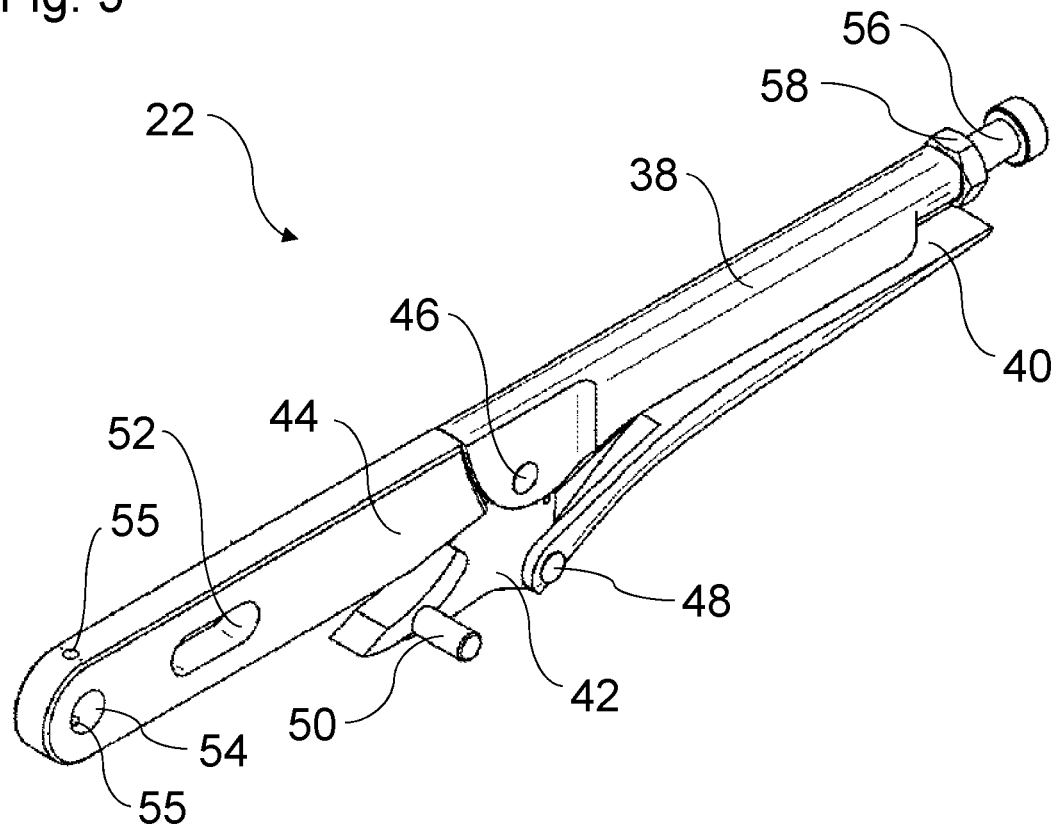
FIG. 5 shows a detailed view of a tool body of the device for bending a split pin.

The holding component 20 by means of the fulcrum pin 36 can be mounted so as to be rotatable on the tool body 22 (cf. FIGS. 2, 3, and 5). The fulcrum pin 36 can have a threaded portion (not illustrated). The threaded portion can be disposed on an end of the fulcrum pin 36 that is opposite the plate region 28.

FIG. 5 shows the tool body 22. The tool body 22 has a first handle part 38, a second handle part 40, an intermediate element 42, and an outrigger 44.

The tool body 22 functions according to the known principle of the locking pliers (vice-grip wrench). In some embodiments, the tool body 22, like the locking pliers, can be secured in a tensioned state, and be released from a tensioned state.

The first handle part 38 by way of a first pivot axle 46 is pivotally connected to the intermediate element 42. The intermediate element 42 by way of a second pivot axle 48 is connected to the second handle part 40. The second handle part 40 by way of a deflection (not illustrated) is moreover connected to the first handle part 38 such that the intermediate element 42 pivots in the direction toward the outrigger 44 when the handle parts 38, 40 are converged (principle of the locking pliers). Supporting the deflection (not illustrated) on the first handle part 38 is performed by way of a sliding bolt 56 in the interior of the first handle part 38. The (axial) position of the sliding bolt 56 (and thus the opening width between the intermediate element 42 and the outrigger 44) can be set by way of a counter nut 58, as is the case with a pair of adjustable locking pliers. The thrust bar 24 (cf. FIGS. 2, 3, and 6) by way of a third pivot axle 50 is pivotally connected to the intermediate element 42. The pivot axles 46, 48, and 50 run parallel with one another, so as to be mutually spaced apart. The first and the second pivot axle 46 and 48 can have rivet connections, for example.

The outrigger 44 has a slot 52 and a receptacle 54. The slot 52 is configured as a through bore. The fulcrum pin 36 of the holding component 20 (cf. FIG. 4) in the assembled state extends through the slot 52. The holding component 20 is thus displaceable along a longitudinal direction of the slot 52. The receptacle 54 serves for fastening the bending element 26. The outrigger 44 can furthermore have two through bores 55 which each extend from an external circumferential face of the outrigger 44 toward an external face of the receptacle 54. A tension pin for fastening the bending element 26 (cf. FIG. 7) can be inserted into the through bores 55, for example.

Figure 6:
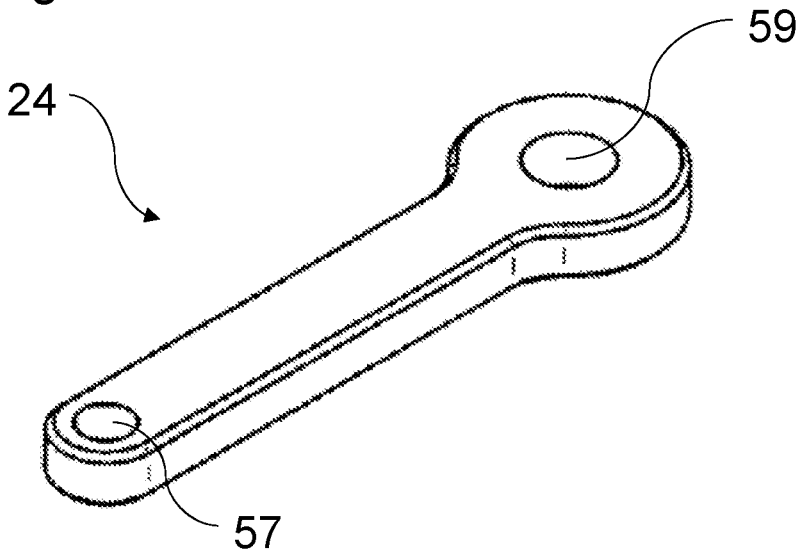
FIG. 6 shows a detailed view of a thrust bar of the device for bending a split pin.

FIG. 6 shows the thrust bar 24. The thrust bar 24 connects the fulcrum pin 36 of the holding component 20 (cf. FIG. 4) to the third pivot axle 50 of the tool body 22. The third pivot axle 50, in particular in an assembled state, can be pivotably mounted in a first opening 57 of the thrust bar 24. The fulcrum pin 36 can be mounted in a second opening 59 of the thrust bar 24. The first opening 57 and the second opening 59 are disposed at opposite ends of the thrust bar 24.

Figure 7:
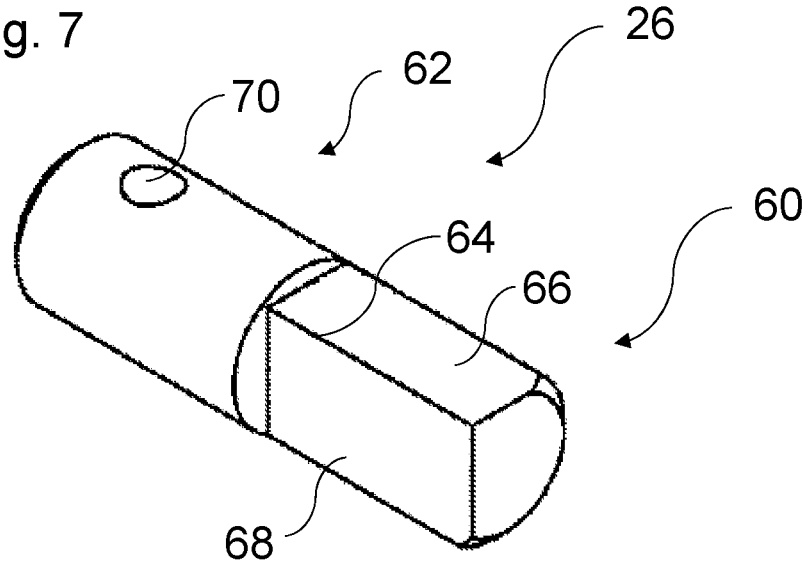
FIG. 7 shows a detailed view of a bending element of the device for bending a split pin.

FIG. 7 shows the bending element 26. The bending element 26 can have a bending portion 60 and a fastening portion 62.

The bending element 26 is configured for being fastened in a rotationally fixed manner in the receptacle 54 of the tool body 22 (cf. FIG. 5).

The split pin ends of the split pin 4 (cf. FIG. 1) can be bent back on the bending portion 60. To this end, the bending portion 60 has one bending edge 64, one first bending face 66, and one second bending face 68. The bending edge 64 connects the two bending faces 66 and 68. The bending edge 64 extends in a longitudinal direction of the bending element 26. The bending edge 64 and the bending faces 66, 68 can be milled, for example. The bending faces 66 and 68 can enclose a right angle.

The bending element 26 can be fastened to the tool body 22, in particular in the receptacle 54 (cf. FIG. 5) by way of the fastening portion 62. The fastening portion 62 can have a bore (through bore) 70 for receiving the tension pin for fastening the bending element 26 to the tool body 22. The bore 70 can be bored, for example.

FIGS. 2 and 3 show the device 18 in the assembled state. In particular, the thrust bar 24 is pivotally connected to the intermediate element 42 by way of the third pivot axle 50 and of a connection element 71, for example a screw.

The holding component 20 is mounted so as to be rotatable in the tool body 22 and in the thrust bar 24, and is axially (in a longitudinal direction of the fulcrum pin 36 (cf. FIG. 4)) secured by a connection element 72, for example a screw. The connection element 72 can be screw-fitted on a threaded portion of the fulcrum pin 36 (cf. FIG. 4), for example.

The holding component 20 within the slot 52 (cf. FIG. 5) is furthermore displaceable along a longitudinal direction of the outrigger 44. A displacement of the holding component 20 can be caused by converging (tensioning, arresting) the first and the second handle part 38, 40. Specifically, pivoting of the intermediate element 42 in the direction toward the outrigger 44 is herein caused by the deflection described. On account thereof, the thrust bar 24 displaces the holding component 20 in the direction toward the bending element 26. If the arresting mechanism between the first and the second handle part 38, 40 is released, the intermediate element 42 pivots away from the outrigger 44. The thrust bar 24 displaces the holding component 20 in a direction that is opposite to that of the bending element 26.

The procedure for bending the split pin 4 (cf. FIG. 1) is as follows. The split pin ends of the legs 14 and 16 are bent so far apart that the bending element fits therebetween. The device 18 is placed onto the castellated nut 2. The fastening elements 34 of the holding component 20 herein engage in the clearances 8 of the castellated nut 2. The mounting 32 of the holding component 20 engages in the split pin head 12 of the split pin 4.

The handle parts 38 and 40 are converged (tensioned). The mounting 32 is displaced in the direction toward the bending element 26. The bending element 26 is located between the split pin ends of the split pin 4. The device 18 placed thereon can now be pivoted in a first circumferential direction about the longitudinal axis of the threaded bar 6. The holding component 20, by virtue of meshing with the split pin 4 and the castellated nut 2, is not conjointly rotated herein. On account thereof, the bending element 26 while being pivoted bends back a first split pin end of the split pin 4. The split pin end comes to bear, for example, on the external circumferential face 7A. The handle parts 38 and 40 can be released, and the device 18 can be pivoted back to the initial position. The handle parts 38 and 40 can be converged again, and the device 18 can be pivoted in a second circumferential direction that is opposite to the first circumferential direction. The second split pin end herein is bent back by the bending element 26 and comes to bear, for example, on the external circumferential face 7B.

The device 18 can be used, for example, for securing a castellated nut for fastening the trailer coupling on a commercial vehicle, for example a truck or bus.

Persons skilled in the art will however recognise that the principle of the device disclosed in an exemplary manner herein for bending the split pin by way of the rotatable mounting can also be applied for bending split pins which are not used for securing a castellated nut. The device can be modified such that the mounting in this instance can then be supported, for example, on one or a plurality of other faces of the component to be secured such that a relative rotation between the mounting and the tool body for bending the split pin is enabled. For example, it is also possible for the device to be provided without the mechanism for the axial displacement of the holding component.

The invention is not limited to the preferred exemplary embodiments described above. Rather, a multiplicity of variants and modifications which likewise use the concept of the invention and therefore are within the scope of the invention are possible. In particular, the invention also claims protection for the subject matter and for the features of the dependent claims independently of the claims referred to.

LIST OF REFERENCE SIGNS

2 Castellated nut
4 Split pin
6 Threaded bar
7 Castellated portion
7A, 7B External circumferential face of the castellated portion
8 Clearance
10 Main body portion
12 Split pin head
14, 16 Legs
18 Split pin bending device
20 Holding component
22 Tool body
24 Thrust bar
26 Bending element
28 Plate region
30 External wall region
32 Mounting
34 Fastening element
36 Fulcrum pin
37 Clearance
38 First handle part
40 Second handle part
42 Intermediate element
44 Outrigger
46 First pivot axle
48 Second pivot axle
50 Third pivot axle
52 Slot
54 Receptacle
54 Through bore
55 Sliding bolt
56 Opening
58 Counter nut
59 Opening
60 Bending portion
62 Fastening portion
64 Bending edge
66 First bending face
68 Second bending face
70 Bore

The invention claimed is:

1. A device for bending a split pin for securing a position of a workpiece said device comprising: a tool body; a holding component for holding the split pin during a bending procedure, wherein the holding component is mounted so as to be rotatable on the tool body; and a bending element which is disposed on the tool body such that an end of a split pin that is held on the holding component is capable of being bent back by a relative rotation on the bending element between the holding component and the tool body; and a mechanism for converting a pivoting movement between two handle parts of the tool body to a translatory movement of the holding component.

2. The device according to claim 1, wherein: a first split pin end of the split pin is capable of being bent back by a relative rotation on the bending element between the tool body and the holding component in a first rotation direction; and a second split pin end of the split pin is capable of being bent back by a relative rotation on the bending element between the tool body and the holding component in a second rotation direction which is counter to the first rotation direction.

3. The device according to either of claim 1, wherein: the holding component holds the split pin on a split pin head of the split pin; and/or the holding component has a mount for holding a split pin head of the split pin.

4. The device according to claim 3, wherein the mount is disposed on a side of the holding component that faces away from the bending element.

5. The device according to claim 1, wherein the holding component during the relative rotation between the holding component and the tool body is securable in a rotationally fixed manner on the workpiece.

6. The device according to claim 1, wherein: the holding component is configured to mesh with the workpiece in order for the holding component to be secured in a rotationally fixed manner on the workpiece, and/or the holding component has at least one fastening element for securing the holding component in a rotationally fixed manner on the workpiece.

7. The device according to claim 6, wherein the at least one fastening element is configured for engaging in at least one clearance in a castellated portion of the workpiece that is configured as a castellated nut.

8. The device according to claim 1, wherein the holding component is configured as a turntable.

9. The device according to claim 8, wherein: the turntable comprises an external wall region disposed on a side of the holding component that faces away from the bending element; and/or the turntable comprises an external wall region configured for partially encompassing the workpiece.

10. The device according to claim 8, wherein the turntable comprises an external wall region that has a clearance space for passing through the split pin.

11. The device according to claim 10, wherein the clearance space is disposed on a side of the holding component that faces away from the bending element.

12. The device according to claim 1, wherein: the holding component is mounted so as to be displaceable on the tool body; and/or the tool body has a slot in which the holding component is displaceably mounted.

13. The device according to claim 1, wherein the mechanism is configured for converting the pivoting movement between two handle parts of the tool body to the translatory movement of the holding component in a direction toward or away from the bending element.

14. The device according to claim 1, wherein the holding component is connected to a thrust bar for displacing the holding component.

15. The device according to claim 14, wherein: the tool body has a first handle part and a second handle part which is pivotably connected to the first handle part; and pivoting of the second handle part in relation to the first handle part causes a displacement of the holding component in relation to the bending element by means of the thrust bar.

16. The device according to claim 1, wherein the bending element comprises a pin.

17. The device according to claim 1, wherein:

the workpiece is a nut; or the workpiece is a castellated nut.

18. The device according to claim 1, wherein: the bending element which is disposed on the tool body such that the end of the split pin that is held on the holding component is capable of being bent back by the relative rotation on the bending element in a manner such that the pin is flushed with the shape of the workpiece.

19. The device according to claim 8, wherein: the turntable having an external wall region which is configured as a ring segment portion; or the turntable having an external wall region which is configured as a half-ring segment portion.

20. The device according to claim 10, wherein the external wall region has the clearance space for passing through a split pin portion that adjoins a split pin head of the split pin.

* * * * *